United States Patent [19]

Stack, deceased

[11] 3,996,080

[45] Dec. 7, 1976

[54] BALLISTIC MODIFIERS

[75] Inventor: Joseph S. Stack, deceased, late of Riverdale, N.J., by Marian C. Stack, heir

[73] Assignee: The United States of America as represented by the Secretary of the Army, Washington, D.C.

[22] Filed: Dec. 16, 1971

[21] Appl. No.: 210,266

[52] U.S. Cl. ..... 149/92; 149/20; 149/95; 149/97

[51] Int. Cl. ..... C06b 25/34

[58] Field of Search ..... 149/92, 19, 95, 20, 149/97

[56] References Cited

UNITED STATES PATENTS

| | | | |
|---|---|---|---|
| 2,362,617 | 11/1944 | Davis et al. | 149/95 |
| 3,379,588 | 4/1968 | Corsi et al. | 149/97 X |
| 3,639,183 | 2/1972 | Crescenzo et al. | 149/92 X |

*Primary Examiner*—Stephen J. Lechert, Jr.
*Attorney, Agent, or Firm*—Nathan Edelberg; A. Victor Erkkila

[57] ABSTRACT

Ballistic modification is accomplished by incorporation oxides of lead and tin in nitramine double-base propellants.

10 Claims, 12 Drawing Figures

INVENTOR.

JOSEPH S. STACK, Dec'd.
MARIAN C. STACK.
BY Harry M. Saragovitz, Edward J. Kelly, Herbert Berl & Victor Erlich INVENTOR.
JOSEPH S. STACK, Dec'd.
BY MARIAN C. STACK
Harry M. Saragovitz, Edward J. Kelly, Herbert Berl
A. Victor Eriksen INVENTOR.
JOSEPH S. STACK Dec'd.
MARIAN C. STACK
BY Harry M. Saragovitz, Edward J. Kelly, Herbert Berl, A. Victor Eckstein

INVENTOR.

JOSEPH S. STACK Dec'd.
MARIAN C. STACK
BY Harry M. Saragovitz, Edward J. Kelly, Herbert Berl
A. Victor Erkkila

BALLISTIC MODIFIERS

The invention described herein may be manufactured, used and licensed by or for the Government for governmental purposes without the payment to me of any royalty thereon.

BACKGROUND OF THE INVENTION

This invention relates to the incorporation of oxides of lead and tin to modify the ballistic properties of high energy double-base propellants containing energetic nitramine crystalline filler.

One of the most desired characteristics of a ballistic rocket employing a propellant is reliability of performance. This reliability of performance is dependent upon many factors one of which is propellant ballistic properties. In this respect a propellant whose burning rate is invarient or nearly invarient to changes in temperature and pressure would be most ideal for an end item application. The variation of propellant burning rate at a given temperature to changes in pressure is expressed as pressure exponent $n$ which is the slope of the burning rate isotherm between two pressure levels obtained from a log plot of burning rate data. As the value of $n$ is lowered the burning rate of the propellant becomes more stable to changes in pressure.

The interdependence of propellant burning rate and pressure to change in temperature is expressed as the temperature coefficient ($\pi_{p/r}$. %/° F) which is the percent change in pressure exhibited by a propellant per degree change in temperature at a constant $p/r$ ratio. The lower the temperature coefficient, the less dependent the burning rate of the propellant is to pressure-temperature changes. Generally, propellants, especially high energy systems are usually capable of exhibiting either favorable pressure exponents or temperature coefficients but systems exhibiting both of these qualities are considered unique.

Combustion catalysts, in the form of organo-metallic and inorganic salts have been employed as ballistic modifiers to obtain the above ballistic effects in double base propellants of low, intermediate, and high energy for a considerable period of time. However, most efficient ballistic modification (stability of burning rate to variations in temperature and pressure) has been realized with double base systems of low to intermediate energy (Q, heat of explosion approximately 640 to 950 cal./gr.), which do not contain explosive crystalline filler, and double base systems of low energy (Q, heat of explosion approximately 600 to 800 cal./gr.) which contain nitramine (cyclotrimethylenetrinitramine, cyclotetramethylene tetra nitramine, etc.) energetic crystalline fillers. All efforts to modify the ballistics of high energy extruded and pourable propellants (Q, heat of explosion 950 cal./gr. and above) containing crystalline nitramines with organo-metallic and inorganic salts have produced systems with only minimal ballistic properties.

It is therefore an object of this invention to provide improved ballistic modification to a high energy nitramine double base propellant.

A further object of this invention is to provide a method of incorporation of the ballistic modifier into the high energy nitramine double base propellant.

Other objects and many of the attendant advantages of this invention will be readily appreciated as the same become better understood by reference to the following detailed description.

According to this invention improved ballistic modification is obtained by incorporation of a mixture of lead and tin oxides into a nitramine double base propellant.

DETAILED DESCRIPTION OF THE INVENTION

Figure 1:
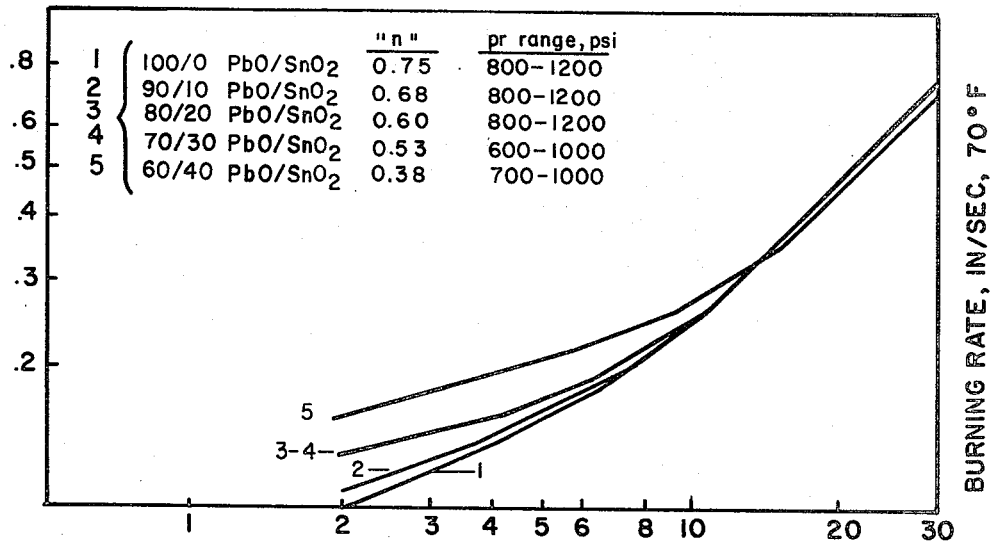

A preferred method of incorporating the oxides of tin and lead into a cross-linked or uncross-linked nitramine double base propellant is described below:

1. To casting solvent $x$, hereinafter described, add resorcinol (if required) and type B fluid ball powder, hereinafter described, and let stand overnight at 70° F.
2. Add the resultant mixture to a vertical sigma blade mixer.
3. Add HMX (cyclotetramethylene tetranitramine), the selected modifier mixture of lead and tin oxides, quick gel (Type C) fluid ball powder, hereinafter described, and 2,4-tolylene diisocyanate (if required) with mixing between additions.
4. Mix for approximately two hours at about 25° to 50° C under a vacuum of 2–4 mm Hg.
5. Cast at a viscosity of approximately 30,000 cps and cure at 60° C for three days.

The fluid ball powders, trademark products of Olin Mathieson Chemical Corporation, having an average particle size of about 7 microns, have the following compositions:

| % Composition | Type B | Type C |
|---|---|---|
| Nitrocellulose, 12.6% N | 90.0 | 74.0 |
| Nitroglycerin | 8.0 | 24.0 |
| 2-Nitrodiphenylamine | 2.0 | 2.0 |
| Dioctylphthalate, added | 0.2 | 0.1 |
| Carbon Black, added | 0.01 – 0.03 | — |

The composition of casting solvent $x$ is as follows:

| Composition | % by Weight |
|---|---|
| Triethylene glycol dinitrate | 65.0 |
| Butanetriol trinitrate | 34.0 |
| 2-Nitrodiphenylamine | 1.0 |

The composition of a typical nitramine double base propellant as prepared above is:

| Composition | % by Weight |
|---|---|
| Fluid Ball Powder B | 18.5 |
| Fluid Ball Powder C | 1.0 |
| Casting Solvent "x" | 46.5 |
| HMX | 30.0 |
| Modifier | 4.0 |

The resorcinol and 2,4-tolylene diisocyanate are added to the above formulation when cross-linking of the propellant is desired.

Burning rate data for nitramine double base propellants containing various mixtures of lead and tin oxides and 0 to 50% HMX are given in the following table:

TABLE I

| | | | | | | | | | | | |
|---|---|---|---|---|---|---|---|---|---|---|---|
| Fluid Ball Powder B | 27.4 | 25.9 | 24.4 | 23.0 | 21.6 | 20.0 | 18.5 | 17.2 | 16.6 | 15.1 | 13.6 |

TABLE I-continued

| | | | | | | | | | | | |
|---|---|---|---|---|---|---|---|---|---|---|---|
| Fluid Ball Powder C | 1.0 | 1.0 | 1.0 | 1.0 | 1.0 | 1.0 | 1.0 | 1.0 | — | — | — |
| Casting Solvent "x" | 67.6 | 64.1 | 60.6 | 57.0 | 53.4 | 50.0 | 46.5 | 42.8 | 39.4 | 35.9 | 32.4 |
| HMX | 0.0 | 5.0 | 10.0 | 15.0 | 20.0 | 25.0 | 30.0 | 35.0 | 40.0 | 45.0 | 50.0 |
| Modifier | 4.0 | 4.0 | 4.0 | 4.0 | 4.0 | 4.0 | 4.0 | 4.0 | 4.0 | 4.0 | 4.0 |
| 30/70 $PbO/SnO_2$: | | | | | | | | | | | |
| Burning Rate, in/sec 70° F, 1000 psi | 0.36 | 0.33 | 0.41 | 0.41 | 0.42 | 0.40 | 0.40 | 0.37 | 0.34 | 0.33 | 0.31 |
| Slope, "n" | 0.38 | 0.53 | 0.25 | 0.18 | 0.06 | 0.14 | 0.11 | 0.23 | 0.26 | 0.24 | 0.27 |
| $\pi_{p/r}$, % /° F, 160° F to −40° F | 0.33 | 0.58 | 0.44 | 0.27 | 0.15 | 0.15 | 0.11 | 0.15 | 0.10 | 0.08 | 0.10 |
| 30/70 $PbO_2/SnO_2$: | | | | | | | | | | | |
| Burning Rate, in/sec 70° F, 1000 psi | 0.38 | 0.41 | 0.40 | 0.36 | 0.43 | 0.41 | 0.38 | 0.38 | 0.34 | 0.31 | 0.29 |
| Slope "n" | 0.40 | 0.46 | 0.20 | 0.15 | 0.04 | 0.00 | 0.15 | 0.09 | 0.06 | 0.06 | 0.12 |
| $\pi_{p/r}$, % /° F, 160° F to −40° F | 0.35 | 0.41 | 0.25 | 0.23 | 0.17 | 0.11 | 0.15 | 0.10 | 0.045 | 0.025 | 0.00 |
| 30/70 $Pb_2O_3/SnO_2$: | | | | | | | | | | | |
| Burning Rate, in/sec 70° F, 1000 psi | 0.36 | 0.39 | 0.33 | 0.36 | 0.41 | 0.40 | 0.40 | 0.38 | 0.36 | 0.32 | 0.30 |
| Slope "n" | 0.49 | 0.40 | — | 0.28 | 0.19 | 0.11 | 0.06 | 0.10 | 0.10 | 0.11 | 0.08 |
| $\pi_{p/r}$, % /° F, 160° F to −40° F | 0.46 | 0.42 | 0.27 | 0.30 | 0.17 | 0.12 | 0.08 | 0.05 | 0.04 | 0.025 | 0.00 |
| 30/70 $Pb_3O_4/SnO_2$: | | | | | | | | | | | |
| Burning Rate, in/sec 70° F, 1000 psi | 0.35 | 0.36 | 0.37 | 0.35 | 0.36 | 0.36 | 0.34 | 0.32 | 0.34 | 0.31 | 0.29 |
| Slope "n" | 0.51 | 0.49 | 0.36 | 0.36 | 0.29 | 0.26 | 0.20 | 0.24 | 0.24 | 0.26 | 0.29 |
| $\pi_{p/r}$, % /° F, 160° F to −40° F | 0.43 | 0.38 | 0.27 | 0.26 | 0.20 | 0.16 | 0.08 | 0.10 | 0.10 | 0.06 | 0.065 |

It is readily apparent from the above Table that as the percentage of crystalline filler (in this case, HMX) is increased in the propellant composition the *n* or slope of the burning rate isotherm decreases along with the temperature coefficient ($\pi_{p/r}$, %/° F). Thusly a more ballistically stable, reliable high energy propellant is produced.

FIGS. 1–12 represent the burning rate pressure × 100 (psi) curves of a high energy nitramine (30% HMX) double base propellant incorporating mixtures of four different oxides of lead and stannic oxide in various ratios. The following table is an interpretation of the curves in the above figures.

TABLE II

Figure 2:
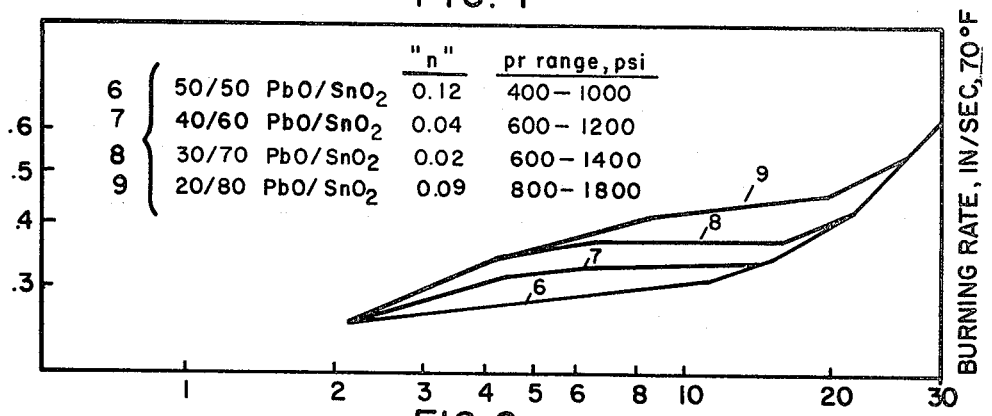
Figure 3:
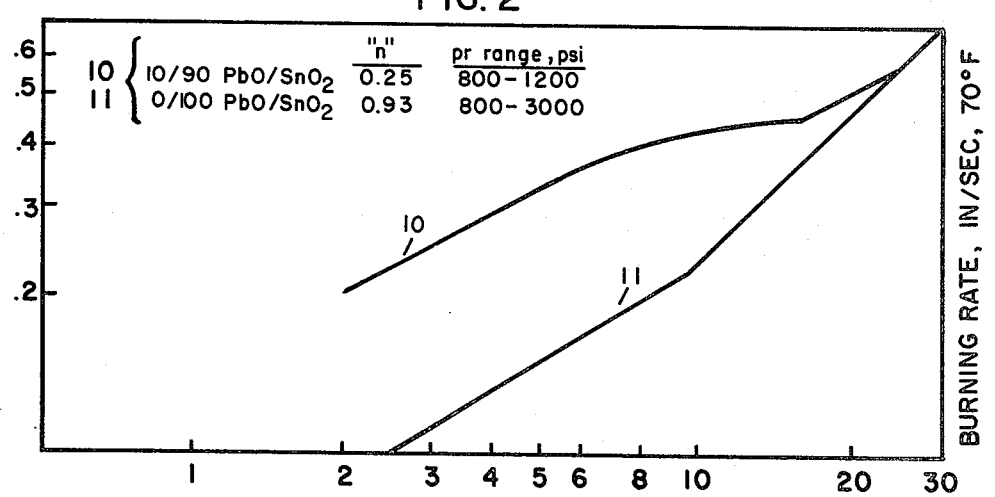
Figure 4:
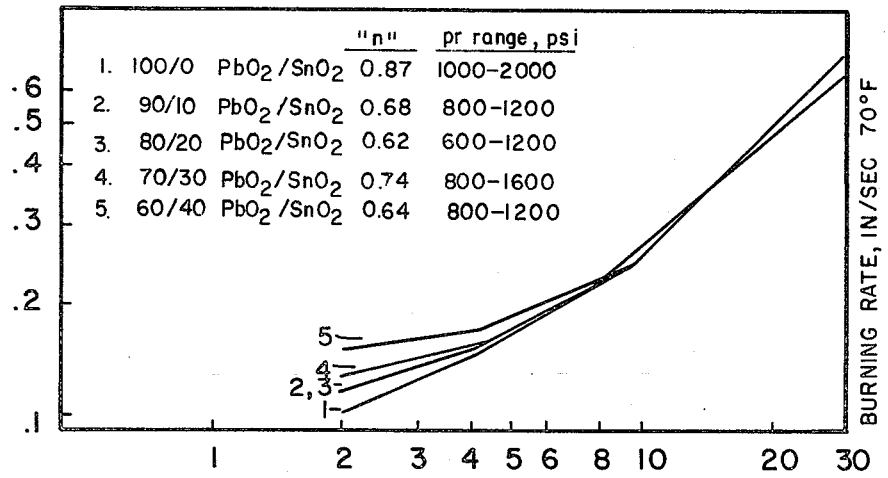
Figure 5:
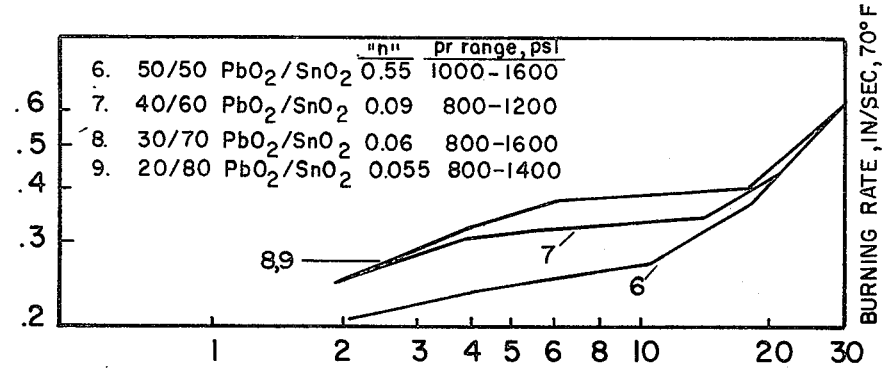
Figure 6:
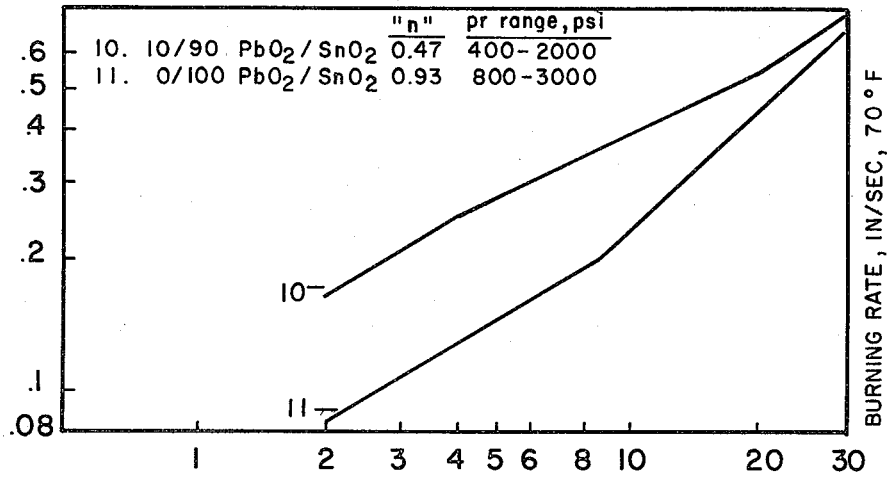
Figure 7:
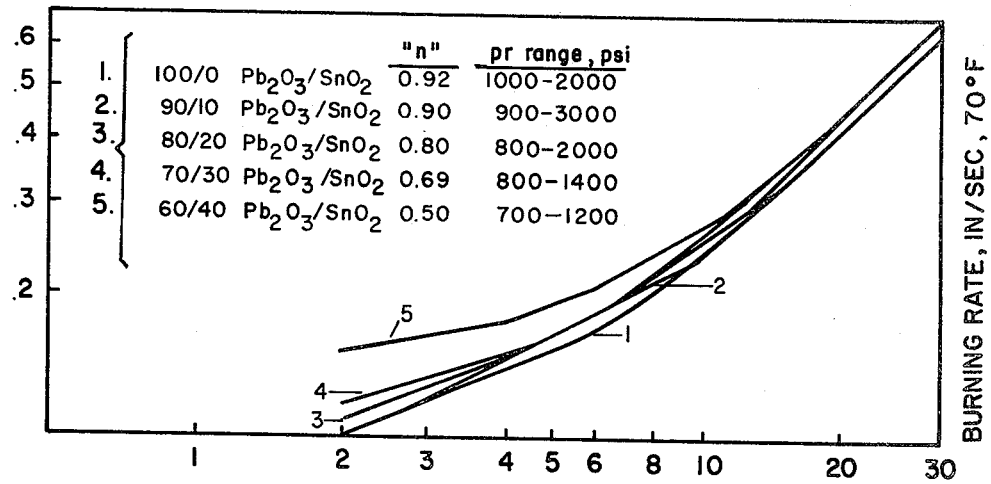
Figure 8:
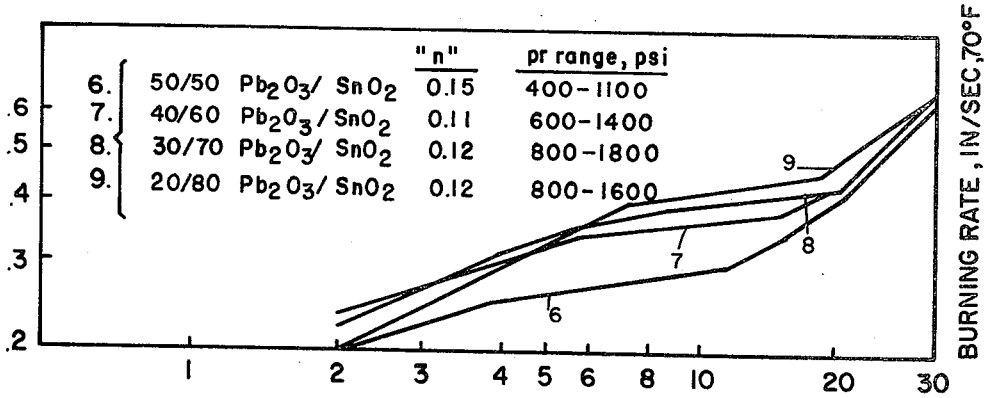
Figure 9:
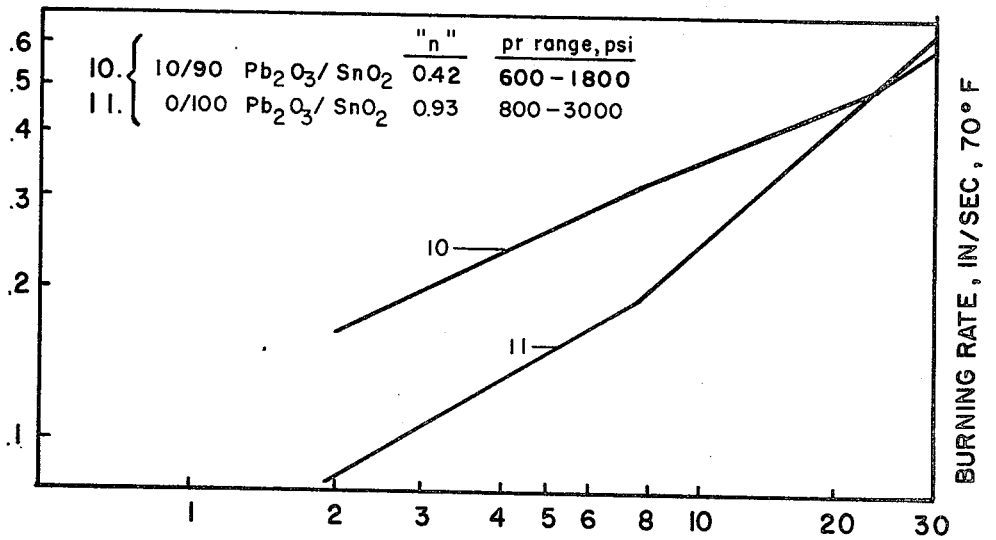

| Ratio-Oxide of Lead/Stannic Oxide | "n" Value |
|---|---|
| FIG. 1: | |
| 1. 100/0 $PbO/SnO_2$ | 0.75 |
| 2. 90/10 $PbO/SnO_2$ | 0.68 |
| 3. 80/20 $PbO/SnO_2$ | 0.60 |
| 4. 70/30 $PbO/SnO_2$ | 0.53 |
| 5. 60/40 $PbO/SnO_2$ | 0.38 |
| FIG. 2: | |
| 6. 50/50 $PbO/SnO_2$ | 0.12 |
| 7. 40/60 $PbO/SnO_2$ | 0.04 |
| 8. 30/70 $PbO/SnO_2$ | 0.02 |
| 9. 20/80 $PbO/SnO_2$ | 0.09 |
| FIG. 3: | |
| 10. 10/90 $PbO/SnO_2$ | 0.25 |
| 11. 0/100 $PbO/SnO_2$ | 0.93 |
| FIG. 4: | |
| 1. 100/0 $PbO_2/SnO_2$ | 0.87 |
| 2. 90/10 $PbO_2$/Sn0 2 | 0.68 |
| 3. 80/20 $PbO_2/SnO_2$ | 0.62 |
| 4. 70/30 $pbo_2/Sno_2$ | 0.74 |
| 5. 60/40 $PbO_2/SnO_2$ | 0.64 |
| FIG. 5: | |
| 6. 50/50 $PbO_2/SnO_2$ | 0.55 |
| 7. 40/60 $PbO_2/SnO_2$ | 0.09 |
| 8. 30/70 $PbO_2/SnO_2$ | 0.06 |
| 9. 20/80 $PbO_2/SnO_2$ | 0.055 |
| FIG. 6: | |
| 10. 10/90 $PbO_2/SnO_2$ | 0.47 |
| 11. 0/100 $PbO_2/SnO_2$ | 0.93 |
| FIG. 7: | |
| 1. 100/0 $Pb_2O_3/SnO_2$ | 0.92 |
| 2. 90/10 $Pb_2O_3/SnO_2$ | 0.90 |
| 3. 80/20 $Pb_2O_3/SnO_2$ | 0.80 |
| 4. 70/30 $Pb_2O_3/SnO_2$ | 0.69 |
| 5. 60/40 $Pb_2O_3/SnO_2$ | 0.50 |
| FIG. 8: | |
| 6. 50/50 $Pb_2O_3/SnO_2$ | 0.15 |
| 7. 40/60 $Pb_2O_3/SnO_2$ | 0.11 |
| 8. 30/70 $Pb_2O_3/SnO_2$ | 0.12 |
| 9. 20/80 $Pb_2O_3/SnO_2$ | 0.12 |
| FIG. 9: | |
| 10. 10/90 $Pb_2O_3/SnO_2$ | 0.42 |
| 11. 0/100 $Pb_2O_3/SnO_2$ | 0.93 |

TABLE II-continued

Figure 10:
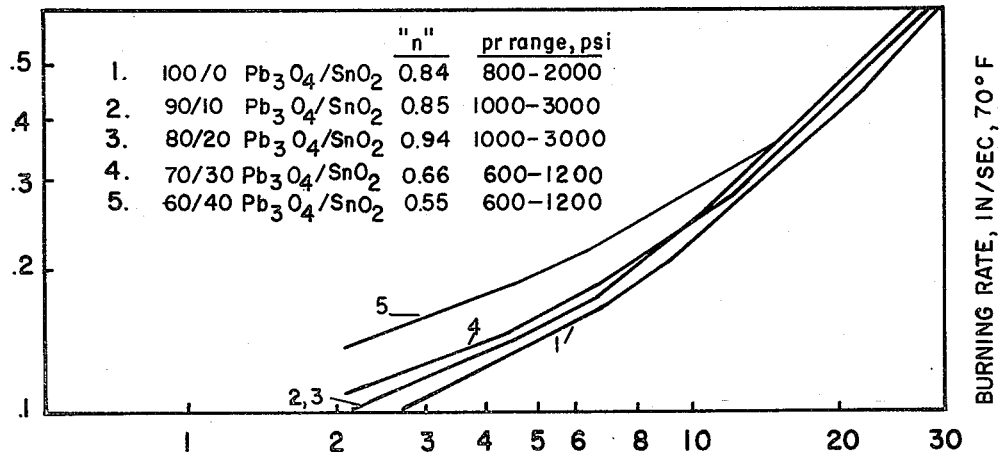
Figure 11:
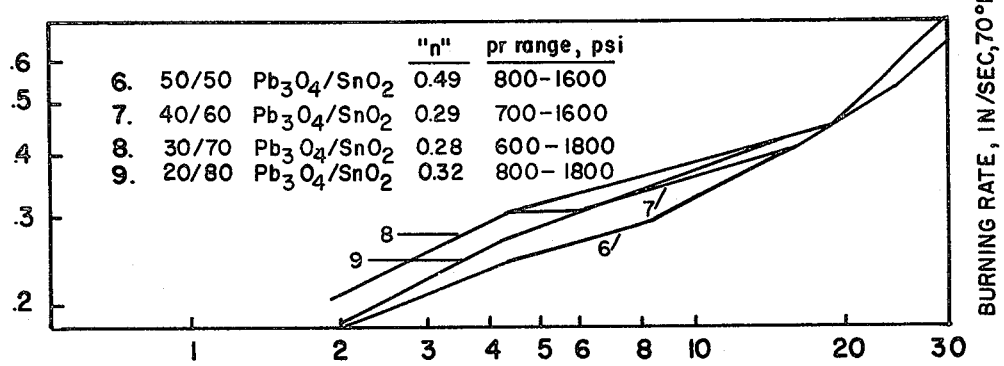
Figure 12:
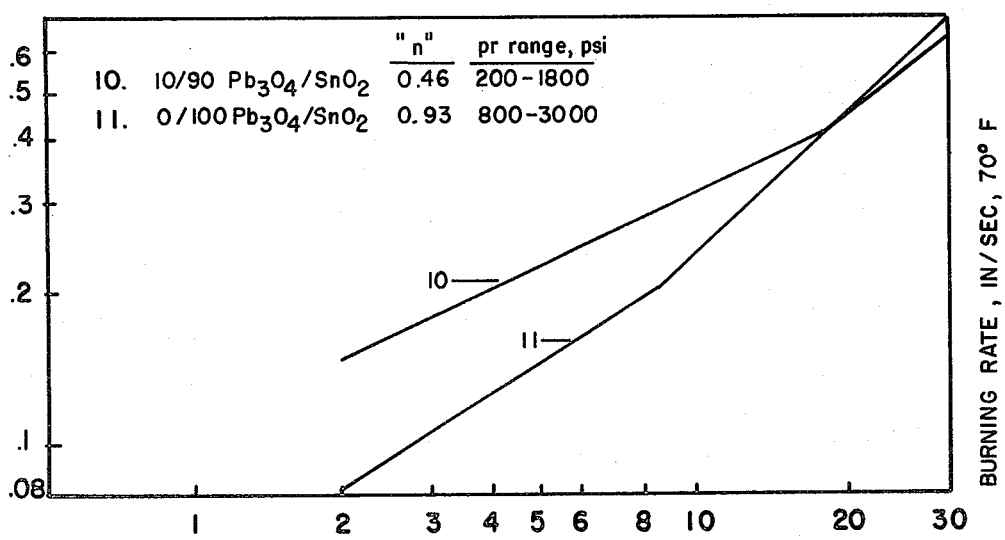

| Ratio-Oxide of Lead/Stannic Oxide | "n" Value |
|---|---|
| FIG. 10: | |
| 1. 100/0 $Pb_3O_4/SnO_2$ | 0.84 |
| 2. 90/10 $Pb_3O_4/SnO_2$ | 0.85 |
| 3. 80/20 $Pb_3O_4/SnO_2$ | 0.94 |
| 4. 70/30 $Pb_3O_4/SnO_2$ | 0.66 |
| 5. 60/40 $Pb_3O_4/SnO_2$ | 0.55 |
| FIG. 11: | |
| 6. 50/50 $Pb_3O_4/SnO_2$ | 0.49 |
| 7. 40/60 $Pb_3O_4/SnO_2$ | 0.29 |
| 8. 30/70 $Pb_3O_4/SnO_2$ | 0.28 |
| 9. 20/80 $Pb_3O_4/SnO_2$ | 0.32 |
| FIG. 12: | |
| 10. 10/90 $Pb_3O_4/SnO_2$ | 0.46 |
| 11. 0/100 $Pb_3O_4/SnO_2$ | 0.93 |

From these burning rate curves and *n* values it is apparent that as the concentration of the selected oxide of lead decreased in the lead oxide/tin oxide modifier employed, the propellant burning rate increased and the pressure exponent (*n*) decreased, that is, the propellant burning rate became less dependent to variations in pressure. Optimum modifying activity in the propellants is effected with mixtures of selected oxides of lead and stannic oxide in ratios ranging from 20/80 to 50/50 oxide of lead/oxide of tin. In general, however, modifying activity takes place from 90/10 to 10/90 oxide of lead/oxide of tin.

The percentage of modifier added to the propellant composition may be varied from about 1 to 5% by weight with optimum modification occurring when about 4% modifier is added.

High energy nitramine propellants which may be modified according to this invention include any double base propellant which incorporates a high energy crystalline filler such as tetryl (2,4,6-trinitrophenyl methyl nitramine), haleite (ethylene dinitramine), RDX (cyclotrimethylenetrinitramine), HMX (cyclotetramethylene tetranitramine) and diethanol nitramine dinitrate in amounts ranging from 10 – 50% of the propellant compositions.

Thusly through the practice of my invention, ballistic modification of high energy nitramine propellants may be obtained such that reliability of performance is increased.

I wish it to be understood that I do not desire to be limited to the exact detail of construction shown and described, for obvious modification will occur to a person skilled in the art.

I claim:

1. A high energy double base propellant composition comprising a nitramine crystalline filler and, as a ballistic modifier, a mixture of lead and tin oxides.

2. The propellant composition of claim 1, wherein the nitramine crystalline filler is selected from the group consisting of 2,4,6-trinitrophenylmethylnitramine, ethylenedinitramine, cyclotrimethylene trinitramine, cyclotetramethylene tetranitramine, diethanol nitramine dinitrate and mixtures thereof.

3. The propellant composition of claim 1, wherein the nitramine crystalline filler is present in the amount of 10 – 50% by weight of the composition.

4. The propellant composition of claim 1, wherein the oxide of lead is selected from the group consisting of lead monoxide, lead dioxide, lead sesquioxide, lead tetroxide and mixtures thereof.

5. The propellant composition of claim 1, wherein the oxide of tin is stannic oxide.

6. The propellant composition of claim 3, wherein the double base propellant comprises nitro-cellulose and at least one nitrate ester from the group consisting of nitroglycerine, triethyleneglycol dinitrate, and butanetriol trinitrate.

7. The propellant composition of claim 6, wherein the oxide of lead is selected from the group consisting of lead monoxide, lead dioxide, lead sesquioxide and mixtures thereof and the oxide of tin is stannic oxide, and wherein the weight ratio of oxide of lead to oxide of tin is between 90 to 10 and 10 to 90.

8. The propellant composition of claim 6, wherein the oxide of lead is lead tetroxide and the oxide of tin is stannic oxide, and wherein the weight ratio of lead tetroxide to stannic oxide is between 10 to 90 and 70 to 30.

9. The propellant composition of claim 8, wherein the weight ratio of oxide of lead to oxide of tin is between 20 to 80 and 50 to 50.

10. The propellant composition of claim 1, wherein the mixture of lead and tin oxides comprises 1 – 5% by weight of the propellant composition.

* * * * *